US006435261B1

(12) United States Patent
Ailiff

(10) Patent No.: US 6,435,261 B1
(45) Date of Patent: Aug. 20, 2002

(54) MECHANISM FOR INVERTING THE COPE OF A MOLDING FLASK

(76) Inventor: Wayne D. Ailiff, 102 N. Pleasantview, Liberty Center, OH (US) 43532

( * ) Notice: Subject to any disclaimer, the term of this patent is extended or adjusted under 35 U.S.C. 154(b) by 22 days.

(21) Appl. No.: 09/752,329

(22) Filed: Dec. 29, 2000

Related U.S. Application Data

(60) Provisional application No. 60/173,813, filed on Dec. 30, 1999.

(51) Int. Cl.[7] ..... B22C 17/08

(52) U.S. Cl. ..... 164/409; 164/402; 266/287; 414/626

(58) Field of Search ..... 266/200, 287; 164/402, 409; 414/626

(56) References Cited

U.S. PATENT DOCUMENTS 1,695,921 A * 12/1928 Harmes ..... 164/402
2,627,335 A * 2/1953 Gedris ..... 164/409
4,202,403 A * 5/1980 Miller ..... 164/409

* cited by examiner

*Primary Examiner*—Scott Kastler
(74) *Attorney, Agent, or Firm*—Donald R. Fraser

(57) ABSTRACT

A mechanism for inverting the cope of a molding flask which includes a frame and support arms pivotally supported by the frame. The cope of the molding flask is attachable to the support to thereby enable the cope to be inverted to permit safe and efficient cleaning and repair.

11 Claims, 3 Drawing Sheets

MECHANISM FOR INVERTING THE COPE OF A MOLDING FLASK

This application claims the benefit of U.S. provisional patent application Serial No. 60/173,813, filed Dec. 30, 1999.

FIELD OF THE INVENTION

The present invention relates to an inverting mechanism for inverting the cope of a molding flask to facilitate repairing and cleaning thereof.

BACKGROUND OF THE INVENTION

Casting is a process used to produce complex parts. A molten metal or alloy is caused to flow into a mold cavity and permitted to solidify. There are four common casting processes characterized by the mold material used, the method for flowing the molten metal into the mold cavity, and the method used to shape the mold cavity. The four casting processes are sand casting, investment casting, permanent mold casting, and die-casting.

Sand casting is the production of metal castings in sand molds. Investment casting is production of a casting in a mold obtained by enclosing an expendable pattern with a heat resisting material such as ceramic, to produce a shell. The expendable pattern may consist of wax, plastic, or other material and is removed prior to filling the mold with liquid metal. In permanent mold casting, molten metal is poured directly into mold cavities cut in metals, alloys, or graphite molds. Permanent mold casting is used for the production of many castings of the same form. Die-casting involves the injection of molten metals into a mold cavity at high pressure. Die-casting is typically limited to the casting of non-ferrous metals.

In sand casting, the molds are generally formed in molding frames or flasks. The molding flask is typically a metal frame. The upper part of the molding flask is known as the cope and the bottom half is the drag. Depending upon the complexity of the mold, additional segments may be required between the drag and cope called the cheek. Together, these molding flask parts form the periphery of the pattern for the cast part. Cores may be required to form internal cavities in the casting.

Molten metal is typically introduced through a sprue hole in the cope to run into the casting cavity. Once the metal has been permitted to harden, the molding flask is separated at parting lines that correspond to the separation between the cope and drag portions. The cast part can then be removed for further machining and other processing to form the finished part.

Once the cast part has been removed from the flask, it is necessary to clean and/or repair the pattern before casting the next part. Cleaning of the drag simply involves positioning the drag on the floor and performing the necessary work. For the cope, the cleaning and repair process may involve suspending the cope from a crane to permit workers to access the open pattern underneath and perform the necessary work. Having workers positioned under a suspended cope presents numerous safety concerns. Serious injury could result if chains or other suspension members failed and permitted the cope to fall. Cleaning and repair is also made difficult due to the workers having to perform the work above their heads on the suspended cope.

An object of the invention is to produce a mechanism for inverting the cope of a molding flask wherein efficiency of the cleaning and repair process is maximized.

Another object of the invention is to produce a mechanism for inverting the cope of a molding flask wherein the cope is fixedly supported to minimize the potential for injury to workers.

Another object of the invention is to produce a mechanism for inverting the cope of a molding flask wherein the labor required for cleaning and repairing the cope is minimized.

SUMMARY OF THE INVENTION

The above, as well as other objects of the invention, may be readily achieved by a mechanism for inverting the cope of a molding flask comprising: a frame including spaced apart ground engaging members and cooperating upstanding supports; a guide member having a longitudinal axis and supported by the frame; at least two support arms, each of the arms having a proximal end and a distal end, the proximal ends of the arms being mounted to the guide member and adapted to slide toward and away from one another and to pivot about the longitudinal axis of the guide member, and the distal ends adapted to pivotally receive the cope of a molding flask; a cope grasping member affixed to at least one of the arms between the proximal and distal ends thereof; and a driver for imparting movement to at least one of the arms to move the arms toward or away from one another.

BRIEF DESCRIPTION OF THE DRAWINGS

The above, as well as other objects and advantages of the invention will become readily apparent to one skilled in the art from reading the following detailed description of the preferred embodiment of the invention when considered in the light of the accompanying drawings, in which.

DETAILED DESCRIPTION OF THE PREFERRED EMBODIMENT

Figure 1:
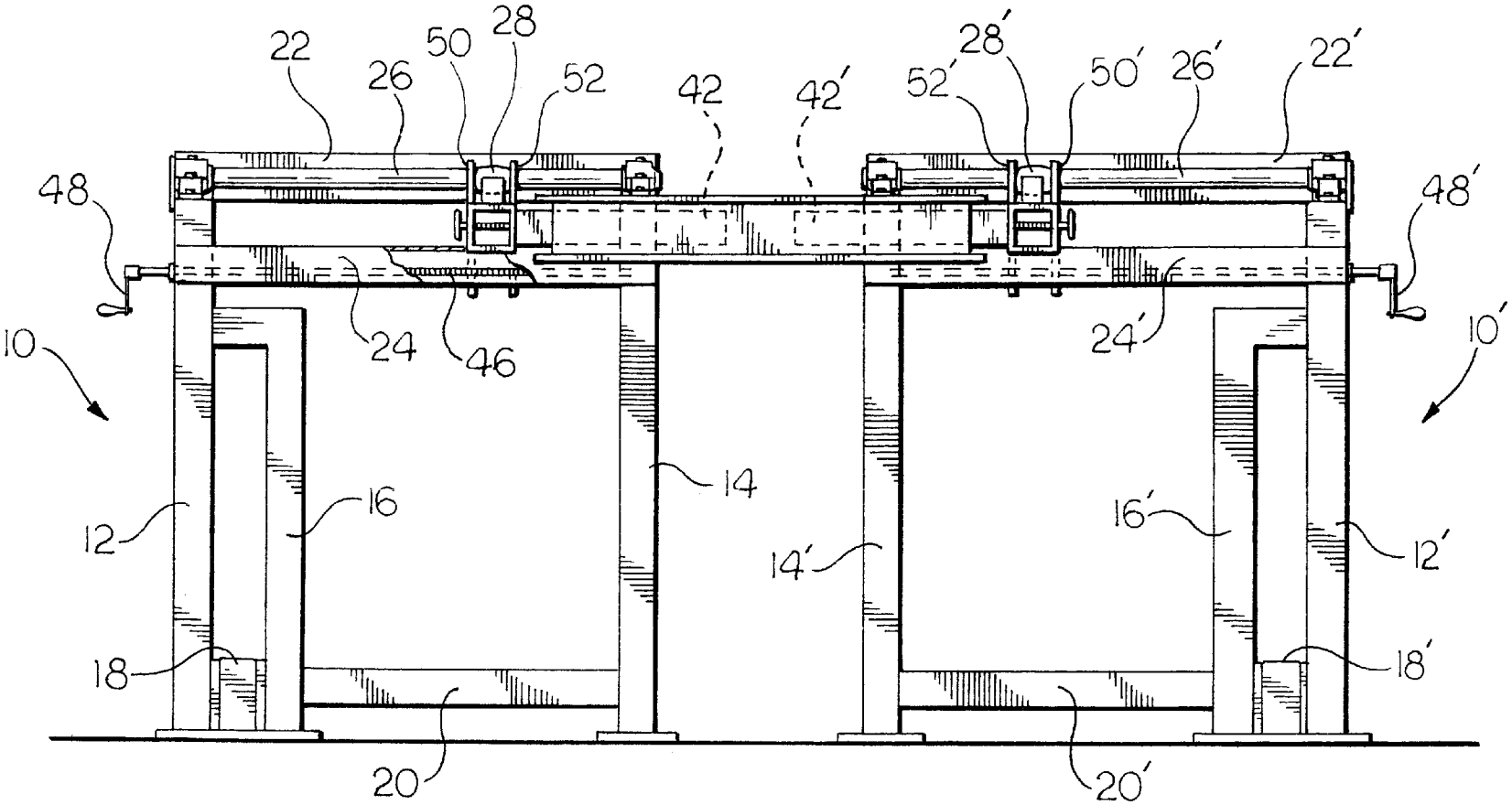
FIG. 1 is a front elevation of a mechanism for inverting the cope of a molding flask embodying the features of the invention.
Figure 2:
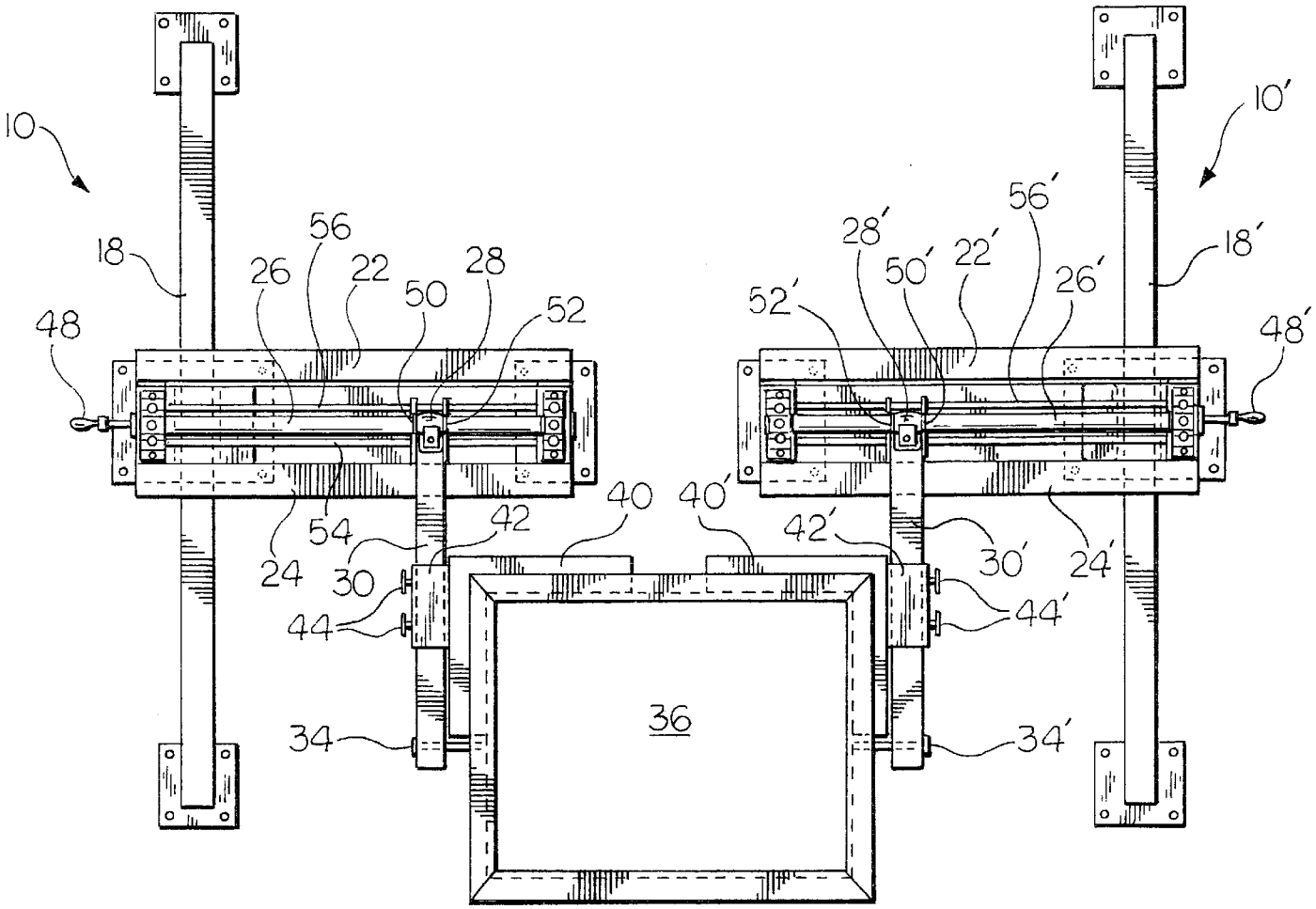
FIG. 2 is a top plan view of the mechanism illustrated in FIG. 1.

Referring to the drawings, there is illustrated a mechanism for inverting the cope of a molding flask which embodies the features of the present invention. The inverting mechanism includes a main frame comprised of a pair of spaced apart frame members 10 and 10'. The frame members are substantially mirror images of one another. In describing the structure of the members 10 and 10', prime numerals will be used to describe similar components.

Each of the frame members 10,10' is provided with a pair of spaced apart upstanding columnar members 12,14 and 12',14', respectively. The outermost members 12,12' are provided with cooperating columnar members 16,16 which are spaced inwardly a sufficient extent to receive between the base or lower ends of the associated members 12,12', laterally extending horizontally disposed frame members 18,18' respectively. As will be appreciated, the members 18,18' are provided to add additional stability to the mechanism to support the load imposed by the molding flask to be supported. Suitable ground engaging pads are employed where necessary to facilitate secure attachment of the mechanism to the floor of a foundry, for example.

Figure 3:
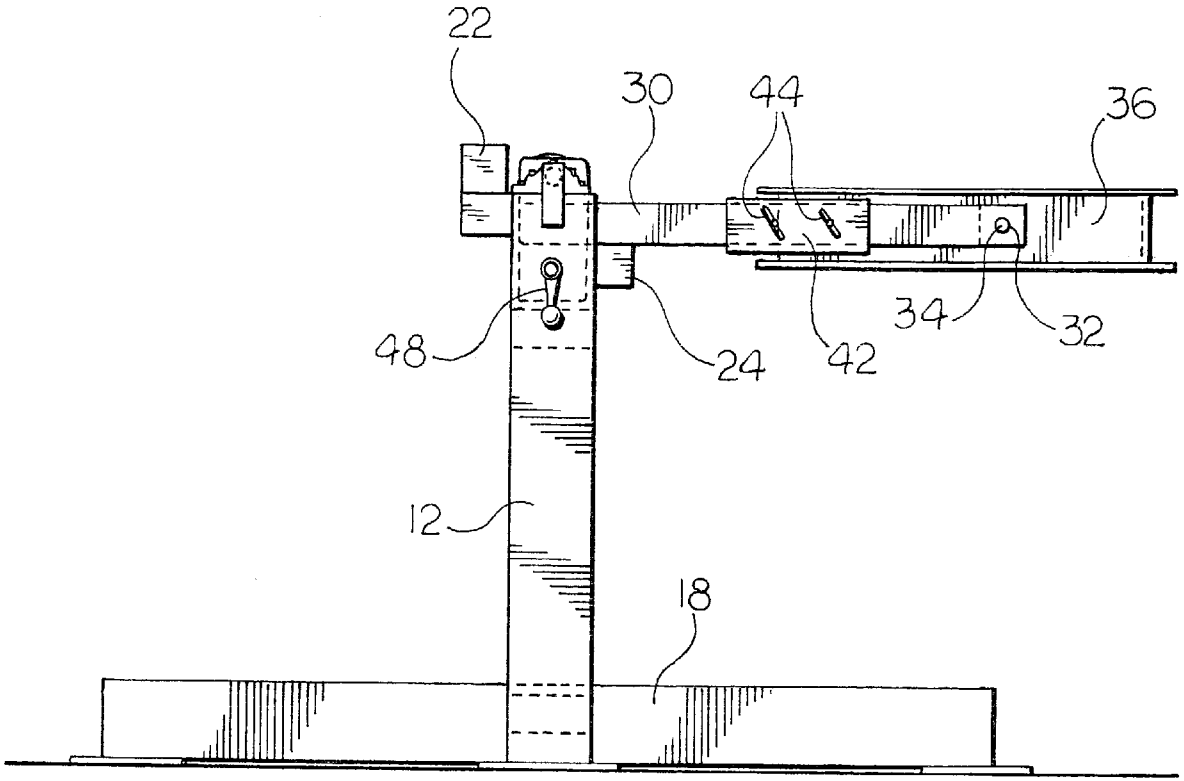
FIG. 3 is a side elevational view of the mechanism illustrated in FIG. 1.

Lower support members 20,20' are disposed to extend between the columnar members 14,16, and 14',16'. Upper support members 22,22' are disposed to extend between the columnar members 12,14 and 12',14' in a slightly rearwardly offset relationship as viewed in FIG. 1. Additional upper support members 24,24' are disposed to extend between the columnar members 12,14 and 12'14' in a slightly forwardly offset relationship in respect of the members 22,22', and positioned at a slightly lower position, as will be apparent in FIG. 3.

Cylindrical guide members 26,26' are disposed to extend from the upper end of the columnar members 12,14 and 12'14', respectively. The guide members 26,26 provide sliding support journal blocks 28,28'.

The proximal ends of cantilevered arms 30,30' are affixed to the respective journal blocks 28,28'. The arms 30,30' are adapted to rest upon the upper surface of the support members 24,24' allowing the arms 30,30 to assume a substantially horizontal position. The terminal or distal ends of the support arms 30,30' are provided with apertures 32,32' for receiving supporting pins 34,34' of a cope 36 of a molding flask.

Cope grasping members 40,40' are sliding fitted on the support arms 30,30' by suitable sleeves 42,42'. The positioning of the sleeves 42,42' on the respective support arms 30,30' is achieved by means of suitable threaded locking members 44,44'.

To and fro adjustment of the support arms 30,30' is accomplished by lead screws 46,46' which are adapted to be operated independently by suitable crank handles 48,48'. The opposite ends of the lead screws 46,46' are typically journaled in the respective facing surfaces of columnar members 12,14, and 12'14'. The external threaded shanks of the lead screws 46,46' are received within internally threaded portions of spaced apart plates 50,52 and 50',52' secured to respective arms 30,30' adjacent the journal blocks 28,28'. Also, to facilitate sliding movement of the journal blocks 28,28', there are provided spaced apart cylindrical guide bars 54,56 and 54',56', the ends of which are suitably secured to the facing surfaces of the columnar member 12,14 and 12',14'.

In operation, the frame members 10,10' are secured to a supporting floor by fastening the support pads to the floor by any suitable means. Next, the handles 48,48' are cranked to separate the support arms 30,30' a sufficient amount to receive the support pins 34,34' of the cope 36 of a molding flask. Typically, a crane is employed to raise the cope 36 such that the support pins 34,34' are aligned with the respective apertures 32,32 in the supporting arms 30,30'. Once alignment is realized, crank handles 48,48' are rotated until the pins 34,34' are fully received within the apertures 30,30'. As the support arms 30,30' are moved toward one another, the grasping members 40,40' are urged firmly against the side of the cope 36 and the threaded locking members 44,44' are tightened, effectively securing the cope 36 between the support arms 30,30'. It will be noted that the load imposed on the support arms 30,30 is in large part, carried by the support members 24,24', respectively.

The crane may then be used to invert the cope 36 about the axis of the guide members 26,26'. The inversion of the cope 36 is accomplished by the lifting of one side of the cope 36. As the edge of the cope 36 is lifted, the support arms 30,30' are caused to pivot around the axis of the guide members 26,26' until the cope 36 has reached the inverted position. In the inverted position, the cope 36 can be readily cleaned or repaired as needed. Once the cleaning or repairs are completed, the crane is use to return the cope 36 to the original position. The crane may then be used to remove the cope 36.

Finally, a crane can couple to the cope 36 and cause the same to be pivoted to an inverted position on the opposite side of the frame members 10,10'. In the inverted position, the support arms 30,30' rest upon the support members 22,22' which are provided to limit the pivotal movement of the support arms 30,30' as well as carry the load thereof.

The columnar members 14, 16, the frame member 18, the support members 20,22, and the cantilever arms 30 and the corresponding prime elements may be form of steel pipe having a rectangular cross-section. The junctions may be formed by any of the known methods of welding, for example.

Although the preferred embodiment of the invention utilizes an adjusting lead screw for each of the separate frame members, it will be understood that a single lead screw with appropriately formed external thread patterns could likewise be utilized.

From the foregoing description, one ordinarily skilled in the art can easily ascertain the essential characteristics of this invention and can made various changes and modifications to the invention to adapt it to various usages and conditions without departing from the spirit and scope thereof, as defined in the appended claims.

What is claimed is:

1. A mechanism for inverting the cope of a molding flask comprising:

a frame including spaced apart ground engaging members and cooperating upstanding supports;

a guide member having a longitudinal axis and supported by said frame the longitudinal axis extending generally perpendicular to the upstanding supports of said frame;

at least two support arms, each of said arms having a proximal end and a distal end, the proximal ends of said arms being mounted to said guide member, said arms adapted to slide toward and away from one another in a parallel relation to one another and to pivot about the longitudinal axis of said guide member, and the distal ends adapted to pivotally receive the cope of a molding flask;

a cope grasping member affixed to at least one of said arms between the proximal and distal ends thereof; and a driver for imparting sliding movement to at least one of said arms to vary the distance between said arms.

2. Mechanism for inverting the cope of a molding flask according to claim 1, wherein said guide member includes a horizontally extending rod member.

3. Mechanism for inverting the cope of a molding flask according to claim 2, wherein the proximal ends of said support arms are pivotally attached to said rod member.

4. Mechanism for inverting the cope of a molding flask as defined in claim 3, wherein said rod member is cylindrical.

5. Mechanism for inverting the cope of a molding flask as defined in claim 3, wherein said rod member is circular in cross-section.

6. Mechanism for inverting the cope of a molding flask as defined in claim 1, wherein said driver includes a lead screw.

7. Mechanism for inverting the cope of a molding flask as defined in claim 6, wherein said lead screw is rotatably mounted to said frame.

8. Mechanism for inverting the cope of a molding flask as defined in claim 7, wherein said lead screw includes a mechanically operated crank.

9. Mechanism for inverting the cope of a molding flask as defined in claim 1, wherein said cope grasping member is adjustably affixed to said arm.

10. Mechanism for inverting the cope of a molding flask as defined in claim 9 wherein said cope grasping member includes a sleeve slidably received on at least one of said support arms.

11. Mechanism for inverting the cope of a molding flask as defined in claim 10 including a threaded fastener for militating against relative movement between said sleeve and said arm.

* * * * *